United States Patent [19]

Davis et al.

[11] Patent Number: 4,517,894

[45] Date of Patent: May 21, 1985

[54] MODULAR SCREEN PRINTING APPARATUS

[76] Inventors: James R. Davis, 61 W. Jefferson Rd., Pittsford, N.Y. 14534; John C. Hoffend, 6029 Logan Rd., Mount Morris, N.Y. 14510

[21] Appl. No.: 515,667

[22] Filed: Jul. 21, 1983

[51] Int. Cl.[3] ..... B85C 17/06

[52] U.S. Cl. ..... 101/126; 101/123

[58] Field of Search ..... 101/114, 115, 123, 126, 101/129, 416 A, 425, 416, 417; 34/41

[56] References Cited

U.S. PATENT DOCUMENTS

| | | | |
|---|---|---|---|
| 954,926 | 4/1910 | Burdick | 101/126 X |
| 1,196,438 | 8/1916 | Doyle et al. | 101/425 |
| 1,781,209 | 11/1930 | Barbera | 101/114 X |
| 1,939,965 | 12/1933 | Flockhart | 101/115 X |
| 2,339,423 | 1/1944 | Pollard | 101/126 |
| 2,846,946 | 8/1958 | Schwarzberger | 101/115 |
| 2,907,118 | 10/1959 | Maescher | 101/416 A |
| 2,984,540 | 5/1961 | Tillett et al. | 101/115 X |
| 4,054,091 | 10/1977 | Bradley | 101/115 X |
| 4,287,826 | 9/1981 | Brabec | 101/115 |
| 4,305,331 | 12/1981 | Colapinto | 101/126 X |

FOREIGN PATENT DOCUMENTS

| | | | |
|---|---|---|---|
| 0078382 | 5/1983 | European Pat. Off. | 101/416 A |
| 263942 | 12/1949 | Switzerland | 101/115 |
| 386840 | 1/1933 | United Kingdom | 34/41 |
| 847857 | 9/1960 | United Kingdom | 101/126 |

*Primary Examiner*—Edgar S. Burr
*Assistant Examiner*—John A. Weresh
*Attorney, Agent, or Firm*—Shlesinger, Fitzsimmons & Shlesinger

[57] ABSTRACT

The basic module comprises a frame, a support which is mounted to reciprocate vertically on the frame adjacent the rear thereof, and a printing screen, which projects horizontally forwardly from the support in cantilever fashion. A cable, which is attached at one end to the support and at its opposite end to the frame, passes intermediate its ends over a plurality of pulleys, certain of which are mounted on the frame, and one of which is attached to a counterweight located beneath the frame. The weight is carried on one end of a pivotal treadle, the opposite end of which is adapted to be manipulated by the foot of an operator standing in front of the frame. Normally the weight is in a lowered position in which it causes the cable to retain the screen in an elevated position, but when the foot treadle is depressed, the weight is lifted and the screen and its support drop by gravity to their lowered positions. The front ends of two of the frames may be secured in confronting relation so that the cantilevered screen can be replaced by a wider screen, opposite side edges of which are supported on the spaced screen supports of the two frames. Furthermore, the supports of two spaced pairs of such confronting frames can be interconnected by a pair of elongate, spaced, parallel rails, which are adapted to support therebetween an elongate, horizontally disposed screen. After work has been printed by such a screen, a heater carriage is disposed to be rolled on the rails over the printed work, and to direct heat onto the surface of the work to dry its inks or dyes.

14 Claims, 5 Drawing Figures

MODULAR SCREEN PRINTING APPARATUS

BACKGROUND OF THE INVENTION

This invention relates to screen printing apparatus, and more particularly to a manually operable screen printing module, any number of which are capable of being connected to each other to form a screen printing device of any desired size. This invention relates also with a drying device for fabrics printed by modular apparatus of the type described.

Most conventional screen printing machines are mounted along one edge thereof to pivot about a horizontal axis between a lower, horizontal position in which the screen printing takes place, and an upper or inclined position in which the screen is swung about its pivotal edge at an angle to the vertical. Moreover, most such prior machines are powered by motors or hydraulic devices, and therefore are expensive to manufacture and costly to replace. Still further, most such powered machines are designed for a specific purpose and for a single-size screen, so that if it is desired to utilize screens of different sizes it is necessary to purchase and maintain a variety of such machines, each having a differently-sized screen.

For example, although U.S. Pat. No. 2,764,084 discloses a manually-operable screen and printing device, the associated screen is designed to be pivoted along its rear edge into and out of its operative position. The disadvantage of such construction is that it is difficult to utilize the machine with any work other than plain, flat materials, which can be placed flat on the machine bed, so as to permit the screen to be pivoted downwardly thereover. Moreover, the machine is suitable for a screen of only one size, and in order to utilize a screen of a different size it is necessary to purchase a similar but larger machine.

There are a number of U.S. patents which disclose the use of vertically movable screens, rather than pivotal screens, such as for example U.S. Pat. Nos. 3,486,441; 4,305,331 and 4,054,091. The first two patents disclose devices which are not designed for manual operation, while the last discloses a footpedal-operated screen. It does not disclose a modular-type screen printing machine which is designed to be connected with one or more like modules to form a screen printing machine of any desired size.

Accordingly, the present invention has for its primary object to provide a relatively inexpensive, manually operable screen printing machine which can be manufactured in a rather small, modular form, so that two or more such machines can be connected in tandem to enhance the overall size of the screen which can be used, as compared to an individual module or machine.

Another object of this invention is to provide an improved, manually operable machine of the type described in which the printing screen is mounted for vertical rather than pivotal movement between its operative and inoperative positions, respectively.

A further object of this invention is to provide a modular machine which utilizes a screen that is supported in cantilever fashion along one side edge thereof, so that the screen can be reciprocated vertically while remaining in a horizontal plane, and also so that two or more such modules can be connected together to increase the overall width and/or length of the associated screen.

Other objects of the invention will be apparent hereinafter from the specification and from the recital of the appended claims, particularly when read in conjunction with the accompanying drawings.

SUMMARY OF THE INVENTION

The basic screen print module comprises a conventional, rectangularly shaped screen, which is fastened along one side thereof to an angle iron or the like. The angle iron is carried on the upper ends of a pair of spaced, parallel rods, which are mounted on a frame to reciprocate vertically at the rear thereof. The screen overlies in cantilever fashion a work-supporting table, which is mounted beneath the screen for vertical adjustment on the frame, or for movement independently of the frame. A foot treadle, which is pivotally mounted on the frame beneath the table, is attached to a weight that is connected by pulleys and a cable to the rods which reciprocate the screen. By pushing down on the treadle at the front of the frame the operator elevates the weight and causes the screen to be lowered to the table top. Conversely, when the operator's foot is removed from the treadle the weight descends and causes the screen automatically to be elevated back to its upper, inoperative position.

The frame of this modular unit is designed in such manner that the two front legs of two such units can be secured in confronting, registering relation to each other to form a machine capable of supporting a screen which is more than twice the width of the screen carried by a single unit. The respective screens can then be removed from the two units and replaced by a much wider screen; and the two pairs of screen operating rods are interconnected by a cable mechanism which causes the operating rods to rise and fall in unison. The larger screen can then be manipulated manually and with the slightest of ease, for movement between its upper and lower operative positions.

The two sets of the interconnected modules can be mounted in laterally spaced relation to support a single, elongate screen, thus to increase the overall length of the machine. This last embodiment is particularly suited for use with a wheel mounted dryer unit which is mounted to roll on the sides of the lowered screen supports and across the top of a printed substrate (fabric, metal, glass, wood, etc.) to dry the printing inks applied through the screen.

THE DRAWINGS

Figure 2:
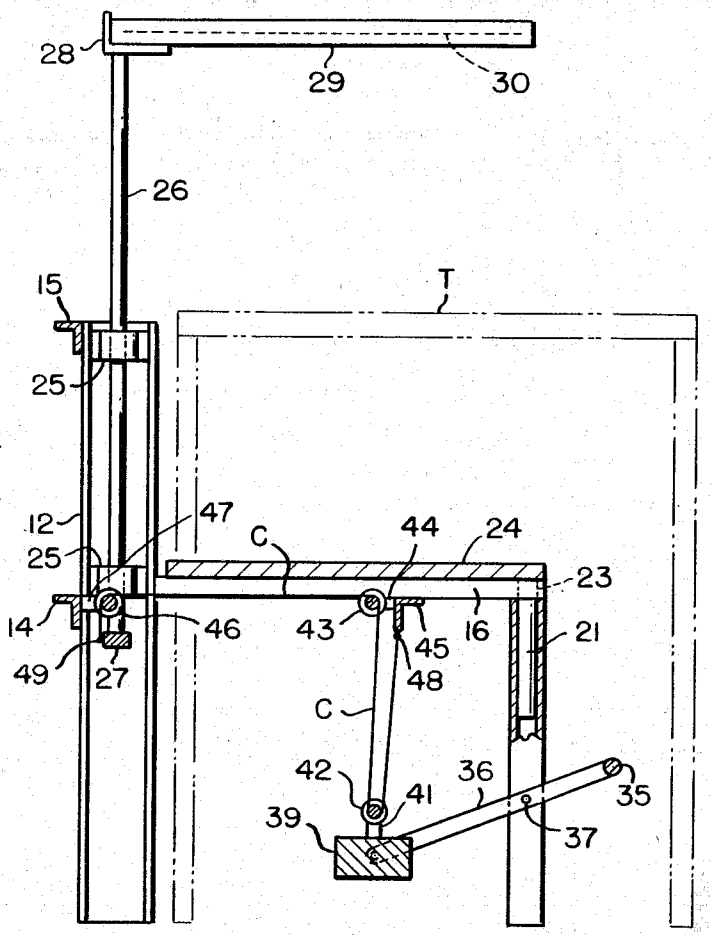
FIG. 2 is a sectional view taken generally along the line 2—2 in FIG. 1 looking the the direction of the arrows, with portions of the unit again being broken away and shown in section for purposes of illustration, and with an alternate form of work table being shown in phantom by broken lines.
Figure 1:
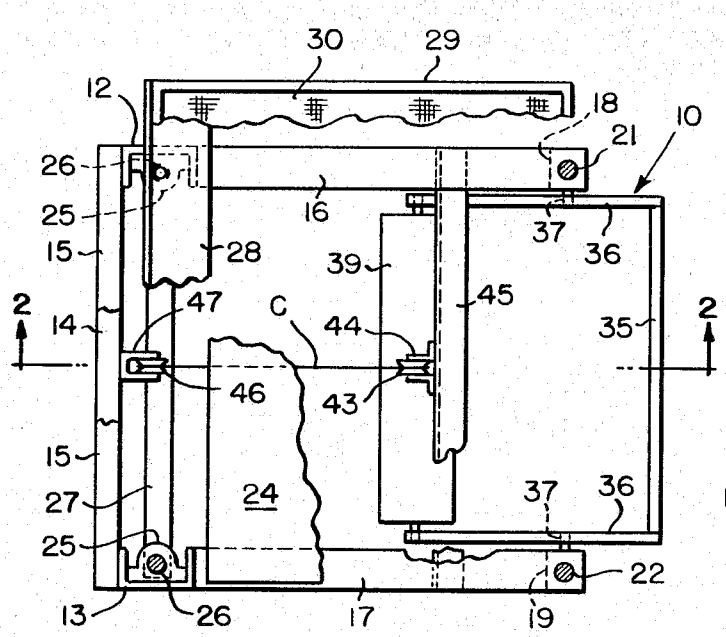
FIG. 1 is a fragmentary plan view of a modular screen printing machine or unit made according to one embodiment of this invention, portions of the machine being broken away and shown in section for purposes of illustration.
Figure 3:
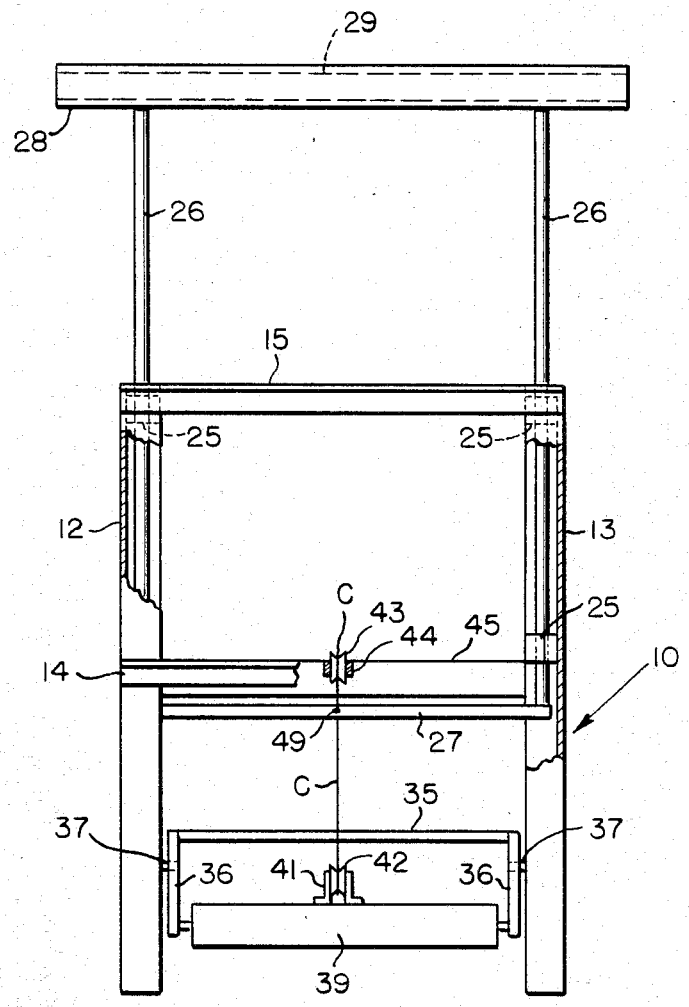
FIG. 3 is a fragmentary rear elevational view of this unit, with parts again being broken away and shown in sections.
Figure 4:
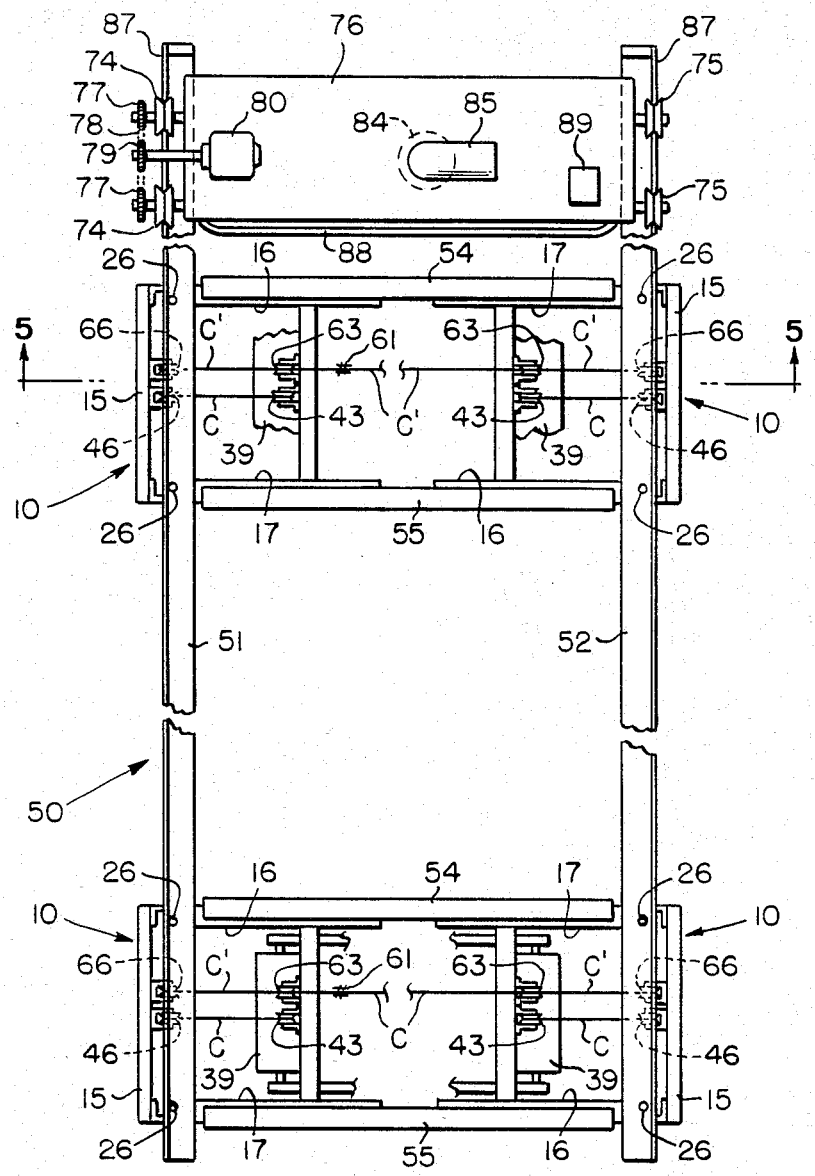
Figure 5:
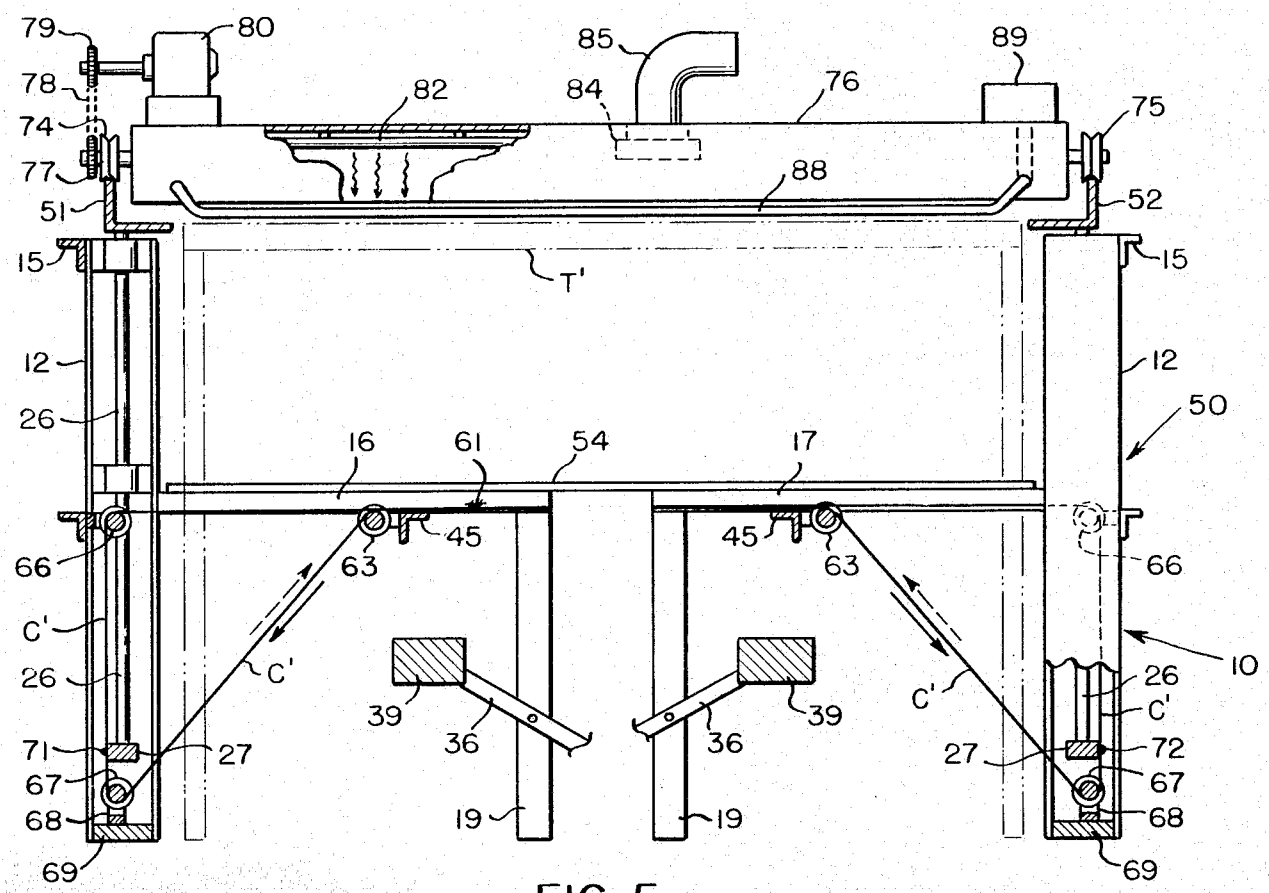

FIG. 4 is an end elevational view of a modified form of this machine produced by connecting together at least two of the modular units shown in FIGS. 1–3, and illustrating a movable dryer which is adapted to be moved across the top of a piece of work after it has been printed; and FIG. 5 is a fragmentary plan view of the machine shown in FIG. 4, but with the printing screen removed for purposes of illustration.

DETAILED DESCRIPTION OF THE PREFERRED EMBODIMENTS

Referring now to the drawings by numerals of reference, and first to FIGS. 1–3, 10 denotes generally the frame of a modular screen printing unit or machine, comprising a pair of vertically disposed, channel-shaped legs 12 and 13, which are secured in spaced, parallel, relation at the rear of the frame by a pair of horizontally extending angle irons 14 and 15. Secured to the sides of legs 12 and 13 medially of their ends, and projecting horizontally forwardly therefrom are two, spaced, parallel rails 16 and 17, the forward ends of which are fastened to the upper ends of a pair of rectangularly shaped posts 18 and 19, respectively, which form two forward legs of the frame.

Mounted for vertical movement in axial bores formed in the upper ends of the frame legs 18 and 19 are two rods 21 and 22, the upper ends of which project slidably through registering openings 23 (FIG. 2) in the side rails 16 and 17 and are attached to the underside of a rectangularly shaped table 24 adjacent its forward or right hand edge as shown in FIGS. 1 and 2. Table 24 extends rearwardly in cantilever fashion to a point adjacent the rear frame legs 12 and 13, and has its marginal side edges overlying the side rails 16 and 17. As noted hereinafter, legs 21 and 22 can be shifted vertically relative to the frame legs 18 and 19 to place table 24 into one of a number of adjusted positions above the side rails 16 and 17.

Secured in the confronting, recessed surfaces of the rear frame legs 12 and 13 adjacent their upper ends are two registering pairs of vertically spaced, linear bearings 25, the bores of which lie in a common vertical plane. Mounted intermediate their ends for vertical sliding movement in the bearings 25 are two screen supporting shafts 26, the lower ends of which are secured to opposite ends of a transverse shaft support member 27, and the upper ends of which are fastened to the underside of an upper shaft support in the form of an angle iron 28. Secured along its rear edge to one leg of the angle iron 28, and projecting forwardly therefrom in cantilever fashion to overlie the table 24, is the frame 29 of a rectangularly-shaped printing screen 30.

Projecting transversely across the front of frame 10 is the closed end or operating arm 35 of a generally U-shaped, foot-operated treadle, which has spaced, parallel legs 36 that are pivotally connected intermediate their ends by coaxial pins 37 to legs 18 and 19, respectively. Pivotally mounted on the inner ends of the treadle legs 36 remote from the operating arm 35 is an elongate, rectangularly shaped weight 39, which tends normally to swing the treadle in a counterclockwise direction about its pivotal axis as represented by pins 37.

Mounted to rotate on a bracket 41, that projects from the upper surface of weight 39 is a pulley 42, the axis of which extends parallel to the pivotal axis of the treadle. Pulley 42 registers with a second pulley 43, which is mounted above the weight 39 to rotate in a bracket 44 that is fixed to a transverse frame support 45, and with a third pulley 46, which rotates on a bracket 47 that projects from the rear frame support 14.

As shown more clearly in FIGS. 2 and 3, the pulleys 42, 43 and 46 are interconnected by a cable C, which is fixed at one end as at 48 (FIG. 2) to member 45, and at its opposite end as at 49 to the lower shaft support 27. Cable C extends from its fixed end 48 downwardly beneath pulley 42, then upwardly over the top of the pulley 43, and then rearwardly and downwardly over the top of pulley 46 to the point 49 where it is secured to member 27. Because of this connection, when an operator presses downwardly of the operating end 35 of the treadle the weight 39 is swung upwardly from its position as shown in FIG. 2, thereby permitting the weight of the screen 30 and its supporting legs 26 to force the attached end 49 of the cable downwardly relative to the rear frame legs 12 and 13, thereby to take up the slack which is produced in the cable upon the elevation of the weight 39. The extent to which the screen 30 is lowered depends, of course, upon the extent to which the treadle is pivoted.

As will be apparent to those skilled in the art, the work which is to be screen printed is first positioned upon the table 24, after which the screen 30 is lowered manually by operation of the treadle arm 35 until the screen engages the upper surface of the work. The necessary ink or dye is then applied by a squeegee or the like to the fabric, after which the treadle is released so that the weight 39 descends and in turn causes the screen to be elevated back to its upper, inoperative position.

From the foregoing it will be apparent that the present invention provides an extremely simple and efficient means for moving a conventional printing screen between its operative and inoperative positions. By utilizing the weight 39 to counterbalance the weight of the screen 30 and its supporting legs 26, the manipulation of the screen by the foot treadle arm 35 is considerably simplified, and leaves the operator's hands free for manipulating the associated squeegee (not illustrated), and any other items that are necessary for affecting the actual screen printing of the work. Experience has indicated that conventional screens of the type which are pivoted between operative and inoperative positions eventually do lead to undesirable bleeding or running of the associated dyes or inks because of the difficulty in repeatedly registering the screen in exactly the same relationship to the work in process. Applicant's novel machine obviates this problem, because the screen is always reciprocated vertically in exactly the same path by the supporting legs 26. Moroever, the screen can be repeatedly registered very accurately with the work thereby substantially improving the "snap" (release of screen from substrate after passage of squeegee) and thus the quality of the screen printing which is effected by the machine.

Still another important advantage of this machine is that the screen 30 is cantilevered above the worktable 24 so that its operating rods or legs 26 are located only at one side of the machine, thereby leaving the opposite or front side of the machine free of any obstructions which might interfere with the placement of work in and out of the machine. Moroever, because of this particular feature, applicant's novel machine is also particularly suited for modular construction of larger screen printing machines, simply by placing two or more modular units side-by-side or end-to-end.

For example, as illustrated in FIGS. 4 and 5, two spaced pairs of modules 10 can be connected together to form a substantially larger machine 50. In this embodiment the standard screen supports 28 of the modules are replaced by two, elongate, screen supporting rails or beams 51 and 52. Rails 51 and 52 are releasably fastened at one end of the machine on the upper ends of the operating shafts 26 of two modules 10, which have their front ends secured in spaced, confronting relation by a pair of tie rails or angle irons 54 and 55, which are releasably fastened at opposite ends thereof to the registering side rails 16, 17 of the two modules. Adjacent the opposite end of machine 50 (the upper end in FIG. 4), the opposite ends of beams 51 and 52 are likewise releasably secured on the upper ends of the operating shafts 26 of another pair of modular units or modules 10, which also are secured in spaced, confronting relation by another set of tie rails 54 and 55.

In this embodiment the two sets of screen supporting shafts 26 of each pair of confronting modules 10 are interconnected by an endless cable C′, opposite ends of which are secured together by a clamp 61. Each cable C′ is mounted on each module to travel about a second set of pulleys 63, 66 and 67, which are mounted to support the cable for travel in a vertical plane which is located adjacent and parallel to the plane containing the standard cable C of the module. As shown more clearly in FIG. 4, the pulleys 63 and 66 of each module are mounted adjacent to, and coaxially of, the pulleys 43 and 46, respectively, of the associated module, while each pulley 67 (FIG. 5) is mounted to rotate on a bracket 68 that projects from the upper surface of a transverse foot plate 69, which extends between the lower ends of the frame legs 12 and 13 of each module.

The cables C′ extend downwardly (FIG. 5) over the pulleys 63 of the left hand modules 10 as shown in FIG. 5, then beneath the pulleys 67 of these modules, then upwardly over the tops of the pulleys 66 and horizontally across the tops of frame members 45 to the associated clamps 61, then from the clamps 61 toward the right in FIG. 5 and downwardly over the pulleys 63 of the right hand modules 10, and then beneath the associated pulleys 67, and then upwardly over the tops of pulleys 66 of the right hand modules and horizontally back toward the left in FIG. 5 across the tops of frame members 45 of the right hand modules, and then once again downwardly over the pulleys 63 on the left hand modules. Moreover, in the confronting modules 10 of each pair thereof the associated cable C′ is fastened or fixed as at 71 (FIG. 5) to the lower shaft support 27 of the left hand module, and as at 72 to the lower shaft support 27 of the right hand module. As a consequence, any vertical movement of the shaft supporting member 27 of either module of a pair thereof will cause a resultant movement in the associated cable C′, and vice versa.

In use, a large printing screen (not illustrated) is mounted along opposite sides thereof on the side rails 51 and 52, and the latter are moved manually between their upper and lower positions simply by pushing them up or down with or against the resistance of the weights 39. Although the weights 39 remain connected to the screen operating shafts 26, the associated treadles face inwardly from opposite sides of the machine 50 and therefore are inaccessable, and are not employed in this machine for manipulating the printing screen. As the shafts 26 are elevated from their lower positions (FIGS. 4 and 5) to their upper positions (not illustrated), the cables C′ travel in the directions indicated by the arrows that are shown by full lines in FIG. 5; and conversely, when the shafts 26 and the associated side beams 51 and 52 are lowered, the cables C′ travel in the directions indicated by the arrows shown by broken lines in FIG. 5. With the two modules 10 of each pair interconnected in this manner, the associated shafts 26 are caused to reciprocate vertically in unison, and consequently the side rails or beams 51 and 52 reciprocate in a like manner, and support the associated printing screen horizontally at all times.

As shown more clearly in FIG. 5, the beams 51 and 52 have upstanding flanges which register with two sets of wheels 74 and 75, respectively, which are mounted on two pairs of rotatable stub shafts that project from opposite ends of an elongate dryer housing 76. Fixed to the outer ends of the shafts which carry the wheels 74 are conventional sprocket wheels 77, which are connected by a chain 78 to a drive sprocket 79 that is fixed to the outer end of the drive shaft of an electric motor 80, which is secured on housing 76 adjacent one end thereof (the left end in FIG. 5).

Mounted in the upper end of the dryer housing 76 is a plurality of flat, infrared heater panels 82 (FIG. 5), which are adapted to be energized from a conventional power source (not illustrated). As noted hereinafter, when the panels 82 are energized they direct heat downwardly through the lower, open end of the housing 76 to dry previously printed work, which is positioned on the top of table T′. Housing 76 also contains a small conventional exhaust fan 84, the output of which communicates with an exhaust duct 85 that projects from the top of housing 76.

In order to permit the screen supporting beams 51 and 52 to move vertically between their upper and lower positions, the housing 76 normally is supported by its wheels 74 and 75 on the upstanding flanges of a pair of stationary side rails 87 (FIG. 4), which are mounted in any conventional manner on the floor adjacent the machine 50 so that their upstanding flanges register with the corresponding upstanding flanges on beams 51 and 52, when the latter are in their lowered positions as shown in FIGS. 4 and 5. Assuming that screen-printed work is positioned at the top of table T′ (FIG. 5), the work is adapted to be dried first by removing the associated screen (not illustrated in FIGS. 4 and 5), and then energizing the motor 80, the heater panels 82 and the exhaust fan 84. The drive shaft of the motor 80 causes the chain 78 to drive the wheels 74, so that the housing 76 begins to travel horizontally off of the stationary side rails 87 and onto the side beams 51 and 52, or downwardly as shown in FIG. 4. As the housing 76 travels over the still-wet work, the heat from the panels 82 vaporizes and drives off the wet inks or dyes, and the exhaust fan 84 draws the vapors upwardly and exhausts them out of the exhaust duct 85. In this manner the screen printed work can be dried before removing it from the table T′. After the work has been dried the direction of rotation of the motor 80 is reversed, and the housing 76 is driven back to its inoperative or rest position as shown in FIG. 4, where it will not interfere with the vertical movement of the side beams 51 and 52.

A vacuum means in the form of a perforated or slotted pipe 88 is secured at opposite ends to the front of the housing 76 to extend transversely across the length of the housing parallel to its lower, forward edge. One end of the pipe 88 is connected to a vacuum source 89 which is mounted on the housing 76, so that when the vacuum source is energized, perforations or slots in the lower surface of the pipe 86 will overlie the screen printed fabric, and will remove any undesired flock or other materials as the drying process takes place.

From the foregoing it will be apparent that the modular units 10 can be connected in a variety of ways to provide screen printing machines of various sizes. Moreover, such units can be built for use with or without a dryer of the type shown in FIGS. 4 and 5 in order to dry a fabric immediately following the screen printing thereof. A major advantage of this invention is that the basic module 10 permits a great deal of versitility, when it comes to screen printing fabrics of different sizes. Unlike most prior art machines, which are designed to handle a single screen of a given size, applicant's modules can be connected together to screen print extremely large pieces of fabric, and conversely can be disconnected to form smaller machines capable of accurately screen printing smaller size fabrics. Moreover, by utilizing the shafts 26 the associated printing screen is maintained in a horizontal plane at all times, and results in improved "snap" and perfect registration of the screen with the work regardless of the number of times the screen is reciprocated relative to the work.

In connection with the above-described modules 10, it is to be understood that the weights 39 may be selected to balance or function as counterweights for the associated printing screens, so that when one of the screens has been shifted to its elevated position it will tend to remain there until lowered by manipulation of the associated treadle, and vice versa. Alternatively the weight can be selected automatically to return the screen to its elevated position, in which case the operator would have to hold the treadle arm 35 in its lowered position during the screen printing operation. Also, when two units 10 are secured together in confronting relation, one or both of the treadle operating arms 35 may be extended laterally to permit foot operation of the screen from one side of the apparatus.

In the application, where it is suggested that the unit is used to print a fabric substrate, it is to be understood that the substrate need not be fabric, but may be wood, glass, metal, plastic, etc. Also, while in FIG. 2 the table 24 is shown to be supported on legs slidable vertically in the front frame legs 18, 19, obviously the table could be supported for vertical movement on the rear frame legs 12, 13, or on all four legs, if desired.

Moreover, while this invention has been illustrated and described in detail in connection with only certain embodiments thereof, it will be apparent that it is capable of still further modification, and that this application is intended to cover any such modifications as may fall within the scope of one skilled in the art or the appended claims.

What is claimed is:

1. A manually operable screen printing machine made by connecting together a plurality of modular screen printing frames, and comprising a pair of like, modular screen printing frames having front ends and rear ends, respectively, means for releasably securing said pair of frames together with the front ends thereof disposed is spaced, confronting relation, a pair of like, laterally spaced screen supports mounted for vertical reciprocation on said frames adjacent the rear ends thereof, a printing screen removably secured along the opposed side edges thereof to said supports and extending horizontally between said supports, a counterweight mounted on each of said frames for offsetting the weights of said supports and said screen, means for suspending each of said counterweights on its respective frame for vertical movement beneath said screen, and operatively connecting each of said counterweights to its associated screen support normally to hold the last-named support releasably in its upper limit position on its associated frame, and means interconnecting said supports for vertical movement manually and in unison between their upper and lower limit positions, thereby to move said horizontally disposed screen between elevated and lowered positions, respectively.

2. A machine as defined in claim 1, wherein said interconnecting means comprises a first set of pulleys mounted on one of said frames for rotation in a common plane about spaced, parallel axes, a second set of pulleys mounted on the other of said frames to rotate in said common plane and about spaced axes parallel to the first-named axes, and a cable secured at spaced points therealong to said supports and mounted to rotate in an endless path around said two sets of pulleys.

3. A machine as defined in claim 2, wherein said counterweight suspending means comprises an additional set of pulleys, an additional cable secured at one end to the associated frame and at its opposite end to the associated screen support, and mounted intermediate its ends to travel around said additional set of pulleys, and means suspending the associated counterweight from said additional cable.

4. A machine as defined in claim 1, including a second pair of modular screen printing frames having the front ends thereof secured in spaced, confronting relation, and being disposed in spaced, side-by-side registering relation with the first-named pair of frames, a pair of spaced, parallel rails extending horizontally between said two spaced pairs of frames, and being releasably secured adjacent opposite ends thereof, respectively, to the screen supports of said first-named and said second pairs of frames, respectively, for vertical reciprocation thereby, and means on said rails for removably supporting a printing screen horizontally therebetween.

5. A machine as defined in claim 4, including a carriage mounted adjacent opposite ends thereof on said rails to travel longitudinally of said rails, and horizontally above work that has been printed by use of said screen, and heater means in said carriage for directing heat through an opening in the bottom of said carriage onto said work.

6. A machine as defined in claim 5, including a plurality of wheels mounted on said carriage adjacent each end thereof to have rolling engagement with said rails and drive means on said carriage for rotating at least certain of said wheels selectively in opposite directions, thereby to move said carriage longitudinally of said rails.

7. A machine as defined in claim 5, wherein said heater means comprises at least one infrared heater element mounted in said housing to direct its rays downwardly.

8. A machine as defined in claim 5, including vacuum means on said carriage having an inlet extending longitudinally of said carriage adjacent the bottom thereof to remove lint and the like from the work over which the carriage travels.

9. A machine as defined in claim 6, including a pair of stationary rails mounted adjacent one end of the first-named pair of rails to register with the latter and with said wheels on said carriage, when said screen supports are in their lower limit positions, whereby said carriage can be moved from said first-named rails and onto said stationary rails, when not in use.

10. A modular screen printing device, comprising a frame, a screen support mounted for vertical reciprocation on said frame adjacent the rear thereof, a printing screen removably secured along one edge to said support and projecting horizontally therefrom in cantilever fashion toward the front of said frame, and means connected to said support and operable manually from adjacent the front of said frame to reciprocate said support and said screen in unison between elevated and lowered positions, respectively, said connecting means including a cable connected at one end to said screen support and at its opposite end to said frame, a movable counterweight for offsetting the weights of said support and said screen, and operative releasably to hold said support and said screen in their elevated positions, and means for suspending said counterweight from said cable for vertical movement beneath said screen, between a first limit position, when said screen is in its elevated position, and a second limit position when said screen is in its lowered position.

11. A device as defined in claim 10, wherein said connecting means further comprises a foot treadle movably mounted on said frame adjacent the front thereof, and said counterweight is connected to said foot treadle for manipulation thereby upwardly when said screen is moved to one of its lowered position, and downwardly when said screen is moved to its upper position.

12. A device as defined in claim 11, wherein said connecting means further comprises a plurality of pulleys supporting said cable intermediate its ends, one of said pulleys being rotatably mounted on said counterweight thereby to suspend the counterweight from said cable intermediate the ends of the latter.

13. A device as defined in claim 10, wherein said support comprises a pair of spaced, parallel, vertically disposed shafts slidably guided in said frame for vertical movement, a lower support member secured to and extending transversely of said shafts adjacent their lower ends, and an upper support member secured to and extending transversely of said shafts adjacent their upper ends, and being releasably secured to said one edge of said screen.

14. A device as defined in claim 13, wherein said connecting means further comprises a first pulley mounted on said frame to rotate above said lower support member and about a first axis that extends transversely of said shafts, a second pulley mounted on said frame to rotate about a second axis parallel to said first axis, and in substantially coplanar relation with said first pulley, said cable being secured at one end to said lower support member and at its opposite end to said frame and passing intermediate its ends over said first and second pulleys, and a third pulley mounted on said counterweight and operatively suspending the latter from said cable thereby normally to cause said cable to hold said screen in its elevated position.

* * * * *